US011073348B2

(12) United States Patent
Sogard et al.

(10) Patent No.: US 11,073,348 B2
(45) Date of Patent: Jul. 27, 2021

(54) TUBE SHAKER

(71) Applicant: HRST, Inc., Eden Prairie, MN (US)

(72) Inventors: Kyle P. Sogard, Minneapolis, MN (US); Lester S. Stanley, Minnetonka, MN (US); Scott J. Bratberg, Maple Grove, MN (US)

(73) Assignee: HRST, Inc., Eden Prairie, MN (US)

( * ) Notice: Subject to any disclaimer, the term of this patent is extended or adjusted under 35 U.S.C. 154(b) by 93 days.

(21) Appl. No.: 16/600,868

(22) Filed: Oct. 14, 2019

(65) Prior Publication Data

US 2020/0393207 A1 Dec. 17, 2020

Related U.S. Application Data

(60) Provisional application No. 62/862,310, filed on Jun. 17, 2019.

(51) Int. Cl.

| | |
|---|---|
| ***F28G 7/00*** | (2006.01) |
| ***F22B 37/48*** | (2006.01) |
| ***B08B 9/023*** | (2006.01) |

(52) U.S. Cl.

CPC ..... *F28G 7/00* (2013.01); *B08B 9/023* (2013.01); *F22B 37/48* (2013.01)

(58) Field of Classification Search

CPC .... F22B 37/48; F28G 7/00–005; F28G 15/02; F23J 3/023; F24H 9/0042; B06B 1/00–20; B08B 7/02; B08B 9/00; B08B 9/02; B08B 9/023; B08B 9/027

USPC ..... 165/5, 84, 95; 15/94, 104.03, 104.04, 15/104.05; 122/379–405

See application file for complete search history.

(56) References Cited

U.S. PATENT DOCUMENTS

2016/0116158 A1 4/2016 Krowech et al.

*Primary Examiner* — Mikhail Kornakov
*Assistant Examiner* — Richard Z. Zhang
(74) *Attorney, Agent, or Firm* — Vidas, Arrett & Steinkraus, P.A.

(57) ABSTRACT

The tube cleaning device has a frame having a plurality of top and bottom vertical slots and a first and second upper slotted bracket, each bracket being located above an upper and lower window. First and second lower brackets are located below the windows forming a ledge. First and second riggings engage the slots and releasably connect the frame to a tube bank. A spreader bar is inserted through a window. A releasable connector secures the spreader bar to the frame. A vibrating motor is releasably secured to the frame. Vibration of the motor is passed through the frame to the spreader bar, which vibrates the tubes to effectuate cleaning.

18 Claims, 4 Drawing Sheets

TUBE SHAKER

CROSS-REFERENCE TO RELATED APPLICATIONS

This application claims the benefit of U.S. Provisional Patent Application Ser. No. 62/862,310 filed Jun. 17, 2019, which is incorporated by reference herein in its entirety.

FIELD OF THE INVENTION

The invention in general is directed to a cleaning apparatus and method which is used to remove dirt or debris from the exterior surface of tubes of a water-tube heat exchanger of a boiler. The cleaning apparatus includes at least one frame which is releasably secured to a vertical tube by a rigging. At least one spreader bar is releasably secured to the frame and extends between a plurality of tubes. A vibrating motor is secured to the frame. Vibration of the motor causes the spreader bar to vibrate whereupon the vibration is transferred to the tubes to remove dirt or debris.

BACKGROUND

In the past tube banks of heat exchangers of boilers become dirty over prolonged use. Dirt and/or debris over time accumulate on the fins and tubes reducing heat transfer efficiency of a tube bank of a heat exchanger. In the past, individuals attempting to clean the tubes of a tube bank have separated individual tubes and/or rows of tubes, and have used sprayers and/or wands having spraying tips to expose the exterior surface of the tubes to pressurized air, water, and/or water mixed with a cleaning agent.

The use of compressed air, water and/or cleaning agents was difficult, messy, and required a significant amount of time to insert and withdraw spreader bars for insertion at another location to clean a different location of a tube bank.

No device has been known to clean the tubes of a heat exchanger which did not spray pressurized air and/or fluid onto a tube bank.

The art referred to and/or described above is not intended to constitute an admission that any patent, publication or other information referred to herein is "prior art" with respect to this invention. In addition, this section should not be construed to mean that a search has been made or that no other pertinent information as defined in 37 C.F.R. § 1.56(a) exists.

All U.S. patents and applications and all other published documents mentioned anywhere in this application are incorporated herein by reference in their entireties.

Without limiting the scope of the invention, a brief description of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided for the purposes of complying with 37 C.F.R. § 1.72.

GENERAL DESCRIPTION OF THE INVENTION

In at least one embodiment, a tube cleaning device includes at least one frame which is releasably secured to the exterior of one or more tubes of a tube bank of a water-tube heat exchanger of a boiler. At least one spreader bar is releasably secured to the frame. The spreader bar is inserted between adjacent tubes in consecutive rows of tubes of the tube bank. The spreader bar upon insertion maintains contact with a plurality of tubes. A vibrating motor is secured to the frame where vibration is transferred to the tubes through the frame and spreader bar. The vibration shakes a plurality of tubes of a tube bank, mechanically removing dirt and/or debris from the exterior surface of the tubes to improve efficiency of the heat exchanger. After the cleaning of a desired section of tubes within the tube bank is complete, then the frame and spreader bars may be relocated to a different location on the tube bank, where cleaning activities may resume.

In at least one embodiment, at least one frame is releasably secured to the exterior surface of at least one tube of a tube bank of a heat exchanger.

In an alternative embodiment, a plurality of frames may be releasably secured to each other forming a frame assembly and the frame assembly may be releasably secured to the exterior surface of a plurality of tubes of a tube bank of a heat exchanger.

In at least one alternative embodiment, each of the frames has a vertical dimension which exceeds a horizontal dimension. Each of the frames include a normally extending left wall, a normally extending right wall, and a back wall. The left wall and the right wall extend outwardly away from the back wall and away from the tube bank.

In some alternative embodiments, each of the back walls include an upper window, and upper slotted bracket above the upper window and a lower bracket below the upper window. In addition, each of the back walls includes a lower window, a second upper slotted bracket above the lower window and a second lower bracket below the lower window.

In some embodiments, each of the back walls include a plurality of regularly spaced vertical slots proximate to a top and a bottom. The vertical slots are constructed and arranged to receive rigging to securely and releasably affix the back wall to at least one tube of a tube bank of a heat exchanger.

In some alternative embodiments, a plurality of frames may be secured to each other by at least one attachment bar. In some embodiments an upper attachment bar and a lower attachment bar may be used to secure adjacent frames together.

In at least one alternative embodiment a vibrating motor may be releasably attached to a central section of a back wall, or below an attachment bar, or between a lower attachment bar and an upper attachment bar.

In at least some alternative embodiments, a spreader bar rests on a lower bracket and extends through either an upper window or lower window for insertion between adjacent tubes of consecutive rows of a tube bank.

An adjustable connector is preferably engaged to and extends through the slot of the upper slotted bracket, extending downwardly to engage the top of the spreader bar. The adjustable connector may then be expanded to create pressure on the spreader bar, securing the spreader bar to the frame between the lower bracket and the upper slotted bracket. The continued expansion of the adjustable connector secures the spreader bar to the frame prior to the commencement of vibration and cleaning activities.

In at least one embodiment, vibration of the vibrating motor is passed through the frame, to the spreader bar, and through the spreader bar to the tubes of the tube bank which are in contact with, and/or are proximate to, the spreader bar. The tubes of the tube bank which contact the spreader bar will vibrate removing dirt and debris, improving the efficiency of the heat exchanger.

These and other embodiments which characterize the invention are pointed out with particularity in the claims annexed hereto and forming a part hereof. However, for further understanding of the invention, its advantages and objectives obtained by its use, reference should be made to the drawings which form a further part hereof and the accompanying descriptive matter, in which there is illustrated and described embodiments of the invention.

DETAILED DESCRIPTION OF THE PREFERRED EMBODIMENTS

Figure 1:
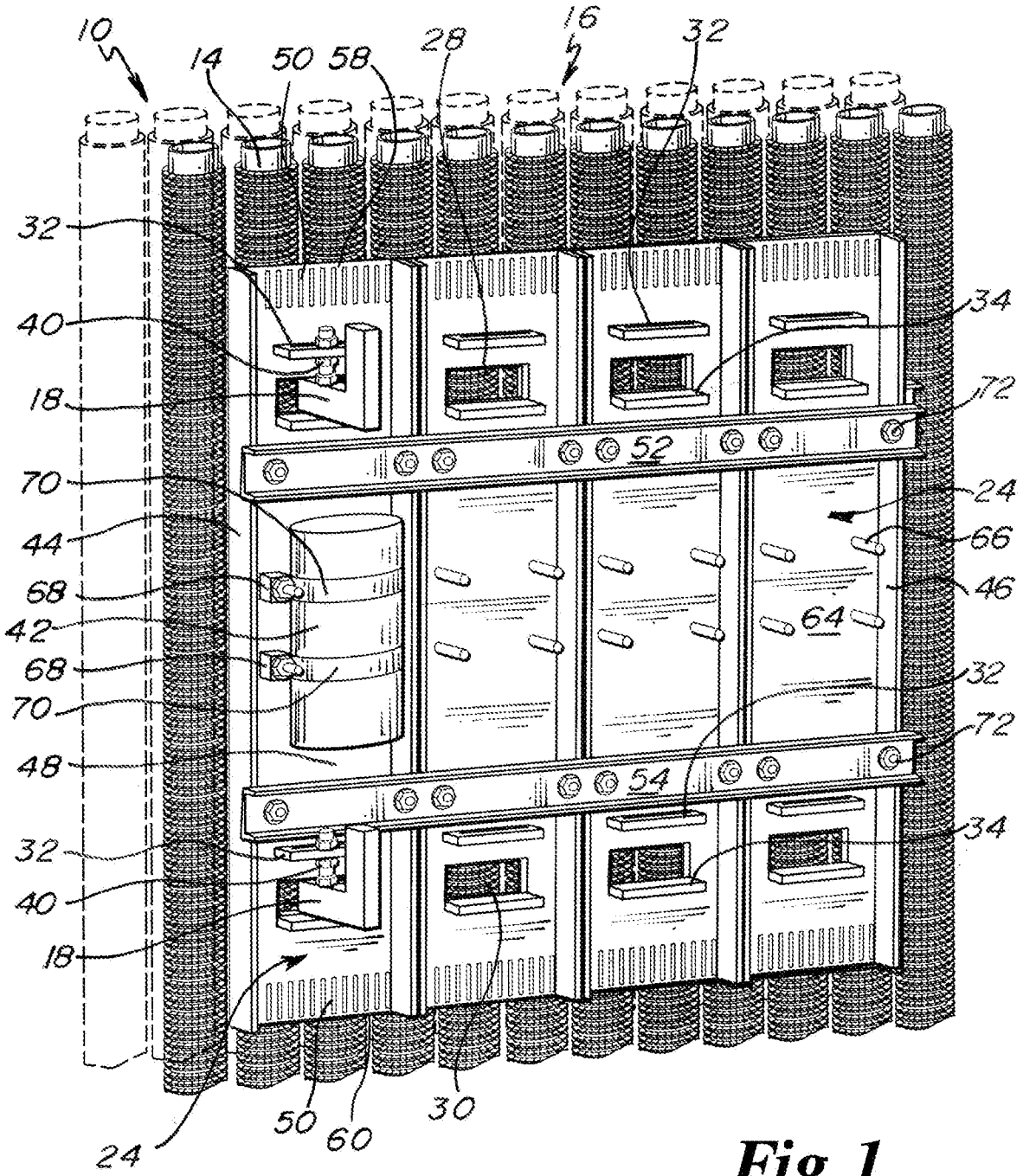
FIG. 1 is an isometric perspective front view of one embodiment of the tube cleaning apparatus.

In general the tube cleaning apparatus is referred to by reference numeral 10. The tube cleaning apparatus 10 and method for cleaning the exterior surfaces of a heat exchanger for a boiler initiates by the identification of a tube bank 16. The tube bank 16 is formed of individual tubes 14 which have fins, and which are required to be cleaned. The tubes 14 and tube bank 16 over time may have accumulated dirt, debris and/or rust on the tubes 14 or fins, which has reduced the operational efficiency of the heat exchanger during use.

As may be seen in FIG. 1, a plurality of tube shaker frames 24 may be vertically positioned adjacent to an exterior row of individual tubes 14 of a tube bank 16. Each frame 24 is preferably adjacent to, and in contact with one, two, or three or more adjacent individual tubes 14. The frames 24 are adapted to be releasably secured to the exterior vertical section of one, two, three or more adjacent tubes 14 of a tube bank 16.

Each frame 24 preferably includes a vertical back wall 48. A right wall 46 extends normally outwardly from the right edge of the back wall 48 in a direction away from the tube bank 16. In addition, a left wall 44 extends normally outward from the left edge of the back wall 48 in a direction away from the tube bank 16. The back wall 48, left wall 44 and right wall 46 generally form a shallow U-shape for the frame 24.

In some alternative embodiments, the back wall 48 has a top 58 and a bottom 60. A plurality of regularly spaced, parallel vertical slots 50 are preferably disposed through each of the top 58 and bottom 60.

In at least one embodiment, an upper slotted bracket 32 is centrally disposed on the back wall 48 between the right wall 46 and left wall 44. The upper slotted bracket 32 preferably extends normally outwardly from the back wall 48 in a direction away from the tube bank 16. The upper slotted bracket 32 is preferably integral or securely affixed to the back wall 48 by welding or another sturdy mechanical attachment mechanism. The upper slotted bracket 32 preferably includes a slot 62. The slot 62 is an elongate opening which is central positioned through the upper slotted bracket 32.

An upper window 28 is adjacent to and is preferably disposed through the back wall 48 below the upper slotted bracket 32. The upper window 28 is also centrally disposed relative to the left wall 44 and right wall 46.

A lower bracket 34 is centrally disposed on the back wall 48 between the right wall 46 and the left wall 44. The lower bracket 34 preferably extends normally outwardly away from the back wall 48 in a direction away from the tube bank 16. The lower bracket 34 is preferably integral or securely affixed to the back wall 48 by welding or through the use of another sturdy mechanical attachment mechanism. The lower bracket 34 preferably establishes a ledge extending outwardly from the bottom edge of the upper window 28.

In some embodiments the length dimension of the upper slotted bracket 32 may be equal to, or more or less than the width dimension of either the upper window 28 or lower window 30. In some embodiments, the length dimension of the lower bracket 34 may be equal to, or more or less than the width dimension of either the lower window 30 or the upper window 28.

In at least one embodiment, the back wall 48 includes a central section 64. The central section 64 may include a plurality of threaded fasteners 66, or alternatively, apertures. The threaded fasteners 66 or apertures may receive mechanical mating fasteners 68 which may be used to engage bands 70. Bands 70 are preferably used to releasably secure a vibrating motor 42 to the back wall 48.

In some embodiments, rigging 36 may be used to secure the vibrating motor 42 to the back wall 48. The rigging 36 may replace a band 70. In addition, the rigging 36 may pass through the back wall 48 and surround one or more tubes 14 to secure the frame 24 and vibrating motor 42 to the tube bank 16.

In at least one embodiment, a second upper slotted bracket 32 is disposed below the central section 64 of the back wall 48. The second upper slotted bracket 32 is preferably centrally disposed between the left wall 44 and right wall 46. The second slotted bracket 32 includes a slot 62.

The second slotted bracket 32, like the slotted bracket 32, extends normally outwardly from the back wall 48 away from the tube bank 16. The second or lower slotted bracket 32 is preferably integral with, or securely affixed to, the back wall 48 by welding or another sturdy mechanical attachment mechanism. The slot 62 of the second slotted bracket 32 defines an elongate opening. The features, attributes, dimensions and functions as earlier described for the upper slotted bracket 32 as positioned proximate to the upper window 28 are equally applicable to the second upper slotted bracket 32 proximate to and above the lower window 30.

It should be noted that in alternative embodiments, that the upper slotted bracket 32 may alternatively be disposed below the upper window 28 and below the lower window 30. Likewise, the lower bracket 34 may alternatively be disposed above the upper window 28 and above the lower window 30.

In yet another embodiment, an upper slotted bracket 32 may be above or below and upper window 28 or lower window 30. Likewise, a lower bracket 34 may be positioned above or below the upper window 28 or lower window 30. In at least one alternative embodiment, one of the upper slotted brackets 32 may be above an upper window 28 and another upper slotted bracket 32 will be below a lower window 30.

In some embodiments, proximate to and below the second upper slotted bracket 32 is a lower window 30. The lower window 30 has the same functions, attributes, dimensions and features as described for the upper window 28. A second lower bracket 34 is preferably immediately below the lower edge of the lower window 30. The second lower bracket 34 preferably has the identical features, attributes, dimensions and functions as earlier described for the lower bracket 34 which is proximate to the upper window 28.

In at least one embodiment, a plurality of regularly spaced, parallel vertical slots 50 are disposed below the lower window 30 proximate to the bottom 60 of the back wall 48.

As may be seen in FIG. 1, a plurality of frames 24 may be disposed adjacent to each other on the exterior surface of a tube bank 16. Each of the plurality of frames 24 is preferably vertically oriented, and the frames 24 are disposed such that a right wall 46 of one frame 24 is disposed proximate to, and in contact with, a left wall 44 of an adjacent frame 24.

In at least one embodiment, the plurality of adjacent frames 24 may be secured to each other through the use of an upper attachment bar 52 and a lower attachment bar 54. The upper attachment bar 52 and lower attachment bar 54 may be secured to the frames 24 through the use of mechanical fasteners such as bolts and nuts 72, which may pass through attachment apertures through the back wall 48.

The upper attachment bar 52 and the lower attachment bar 54 preferably extend horizontally across a plurality of frames 24. The upper attachment bar 52 and lower attachment bar 54 may be located at any desired height relative to the frames 24 or frame assembly. In some embodiments, the upper attachment bar 52 and the lower attachment bar 54 divide or bisect a frame 24 or frame assembly into an upper section, a central section, and a lower section. The upper section, central section and lower section may or may not be equal in dimensions dependent on the specifications of the tubes 14, tube bank 16, windows 28, 30, and spreader bar 18 used during cleaning activities.

In at least one alternative embodiment, a single attachment bar 52, 54 may be used to secure adjacent frames 24 to each other to form a frame assembly. In one embodiment, only an upper attachment bar 52 will be used, or only a lower attachment bar 54 may be used. In another alternative embodiment, a single attachment bar may be centrally positioned between the tops 58 and bottoms 60 extending horizontally across the frames 64. In this embodiment, the vibrating motor 42 may be disposed alternatively above the single attachment bar, or below the single attachment bar.

As may be seen in FIG. 1, a spreader bar 18 is inserted through each of the upper window 28 and lower window 30. The spreader bar 18 is inserted between a plurality of adjacent tubes 14, in a plurality of adjacent rows of a tube bank 16. In alternative embodiments, a spreader bar 18 may optionally be disposed through either the upper window 28 are lower window 30.

In at least one embodiment as shown in FIG. 1, a releasable connector 40 is used to secure a spreader bar 18 following insertion into a tube bank 16, to an upper slotted bracket 32 and lower bracket 34. The releasable connector 40 extends substantially vertically and parallel to the back wall 48, and is preferably formed of a large threaded bolt 74. The threaded head 76 of the large threaded bolt 74 is preferably positioned proximate to, and is in contact with, the top surface 82 of the spreader bar 18. The threaded bolt 74 is also disposed vertically through the slot 62. A first nut 78 is preferably engaged to the bolt 74 in the first unsecured position proximate to the head 76. The bolt 74 is then inserted upwardly through the slot 62 and the head 76 is placed onto the top surface 82 of the spreader bar 18. A second nut 80 is then engaged to the bolt 74 above the slot 62.

In at least one embodiment, a washer (not shown) may be disposed between the first nut 78 and the lower surface of the upper slotted bracket 32 on the bolt 74, and another washer (not shown) may be disposed between the second nut 80 and the upper surface of the upper slotted racket 32.

In at least one embodiment, the first nut 78 is rotated on the bolt 74 away from the head 76 for contact with the lower surface of the upper slotted bracket 32 defining an engaged position. In the engaged position the bottom surface 84 of the spreader bar 18 is in contact with the lower bracket 34 of an upper window 28 or lower window 30.

In the engaged position, the first nut 78 is further rotated through the use of a mechanical device such as a wrench to downwardly force the head 76 onto the top surface 82. The first nut 78 is further rotated until additional rotation is phrohibited. In this engaged position that head 76 and first nut 78 on the bolt 74 have a maximum separation distance establishing vertical force on the spreader bar 18 as secured between the upper slotted bracket 32 and the lower bracket 34. In this fully engaged position the frame 24 is secured to the spreader bar 18 which in turn is engaged to the tubes 14 of the tube bank 16. In the fully engaged position the second nut 80 may be tightened downwardly to pinch the upper slotted bracket 32 between the first nut 78 and second nut 80.

The assembly of the releasable connector 40 may be repeated for the spreader bar 18 disposed through another upper window 28 or lower window 30. In at least one embodiment, in a fully engaged position, a spreader bar 18 will be inserted into a tube bank 16 through each of the upper windows 28 and lower windows 30 of each adjacent frame 24 of a frame assembly.

Following the secure and removable attachment of the releasable connector 40 to the upper slotted bracket 32, lower bracket 34 and spreader bar 18, a vibrating motor 42 may be secured to the central section 64 of any one of the frames 24.

In the embodiment depicted in FIG. 1, the vibrating motor 42 is releasably secured to an outside frame 24 proximate to the left side of a frame assembly. In other embodiments, the vibrating motor 42 may be releasably secured to an inside frame 24 or to an outside frame 24 relative to the right side of a frame assembly. Is anticipated that a single vibrating motor 42 will be used with each frame assembly. The use of multiple vibrating motors may cause harmonic interference and cancellation of vibrations reducing cleaning performance.

In some embodiments, the vibrating motor 42 is preferably powered through electricity. The vibrating motor 42 may be a rotary electric vibrator operating through a 230-460 Volt power source. The vibrating motor may be a 3 horsepower, 60 Hertz motor, operating at up to, or in excess of, 900 RPM, and providing 555 Force lbs of vibration during operation.

The vibrating motor 42 may be releasably secured to a frame 24 through the use of aligned pairs of threaded fasteners 66 which may pass through the central section 64 proximate to each of the left wall 44 and right wall 46. The aligned pairs of threaded fasteners 66 may position the vibrating motor 42 adjacent to a back wall 48. A steel or web band 70 may then be placed to the exterior of the body of the vibrating motor 42 whereupon the aligned pairs of threaded fasteners 66 may be rotated into an engaged position to tighten the band 70 about the exterior of the body of the vibrating motor 42 securing the vibrating motor 42 to the back wall 48. In some embodiments, a single band 70 may be engaged to the vibrating motor 42, and in other embodiments multiple bands 70 may be used to secure the vibrating motor 42 to a frame 24.

In a preferred embodiment, the activation of the vibrating motor 42, as secured to the frame 24, transmits vibration through the frame 24 into the spreader bars 18 to shake debris/dust from the tubes 14 of a tube bank 16.

Figure 2:
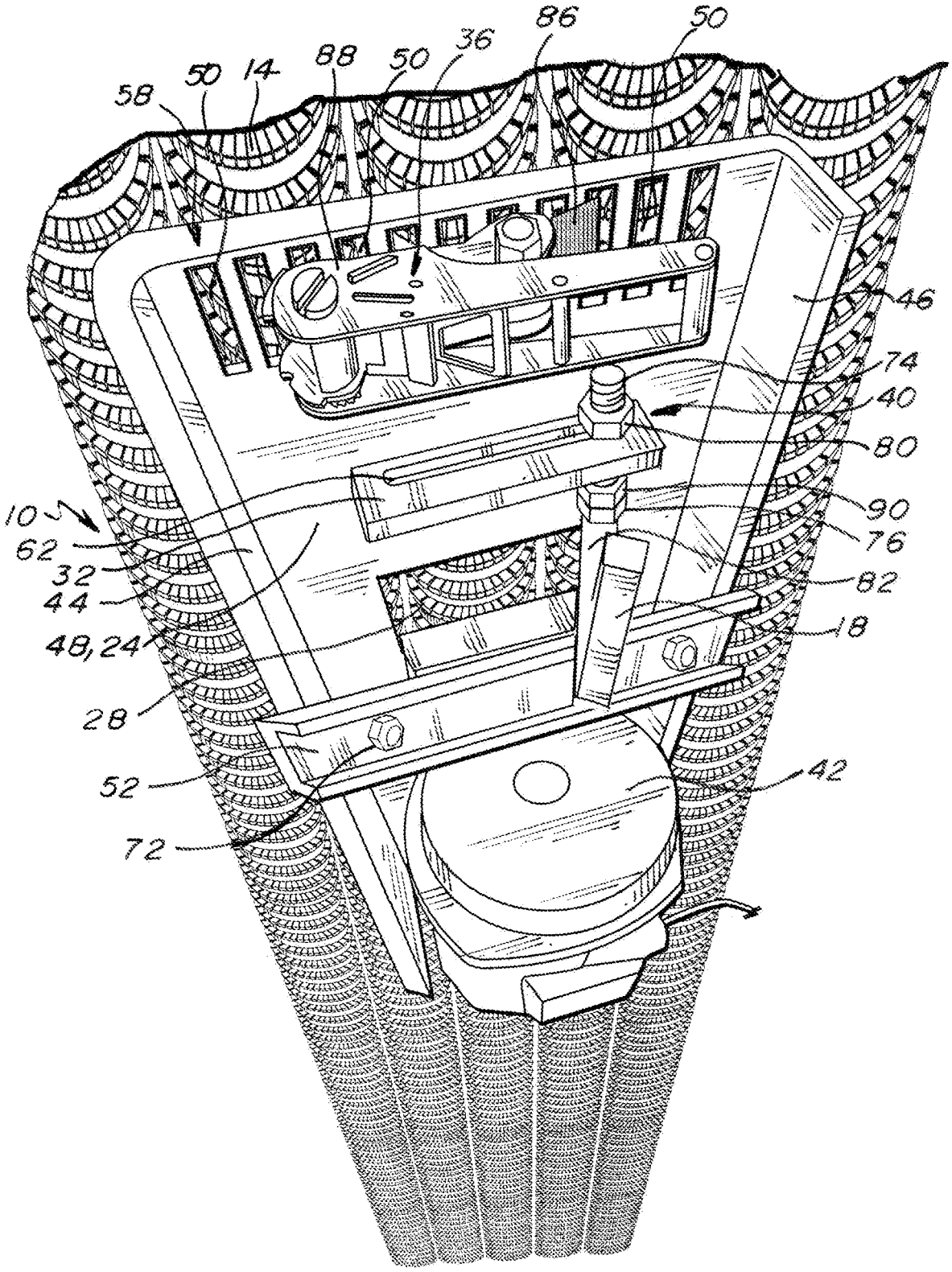
FIG. 2 is a partial detail isometric perspective top view of one embodiment of the tube cleaning apparatus.

Referring to FIG. 2, a rigging 36 is shown releasably securing a frame 24 to one or more tubes 14 prior to the initiation of vibration. The rigging 36 may be used to releasably secure a frame 24 or frame assembly to a tube bank 16 prior to or after the releasable engagement of the vibrating motor 42 to the frame 24. In one preferred embodiment, the frame 24 or frame assembly is secured to a tube bank 16 prior to the attachment of the vibrating motor 42 to the frame 24.

In at least one embodiment as depicted in FIG. 2, the rigging 36 may be formed of a heavy duty cinching web or strap 86 as engaged to a heavy duty ratchet locking buckle 88. The free end of cinching web or strap 86 may be inserted through one of the vertical slots 50 proximate to either the left wall 44 or right wall 46. The free end of the cinching strap or web 86 may then be positioned behind one or more of the first row of tubes 14 of a tube bank 16. The free end of the cinching strap or web 86 may then be pulled forwardly and inserted through another vertical slot 50 adjacent to the opposite left wall 44 or right wall 46. The free end of the cinching strap or web 86 may then be engaged to the buckle 88 which preferably includes a handle and ratchet tightening mechanism. The handle of the buckle 88 is then manipulated to tighten the cinching strap or web 86 to secure the frame 24 to one or more tubes 14 of the tube bank 16. The ratcheting mechanism is used to prevent undesirable loosening of the frame 24 from the tube bank 16 during vibration of the motor 42.

In at least one embodiment, a rigging 36 is used proximate to the top 58 and bottom 60 of each frame 24, or each frame 24 of a frame assembly. A single frame 24 is identified in FIG. 2 for convenience. However, the use of the rigging 36 is preferably used with each adjacent frame 24 of a frame assembly.

Figure 3:
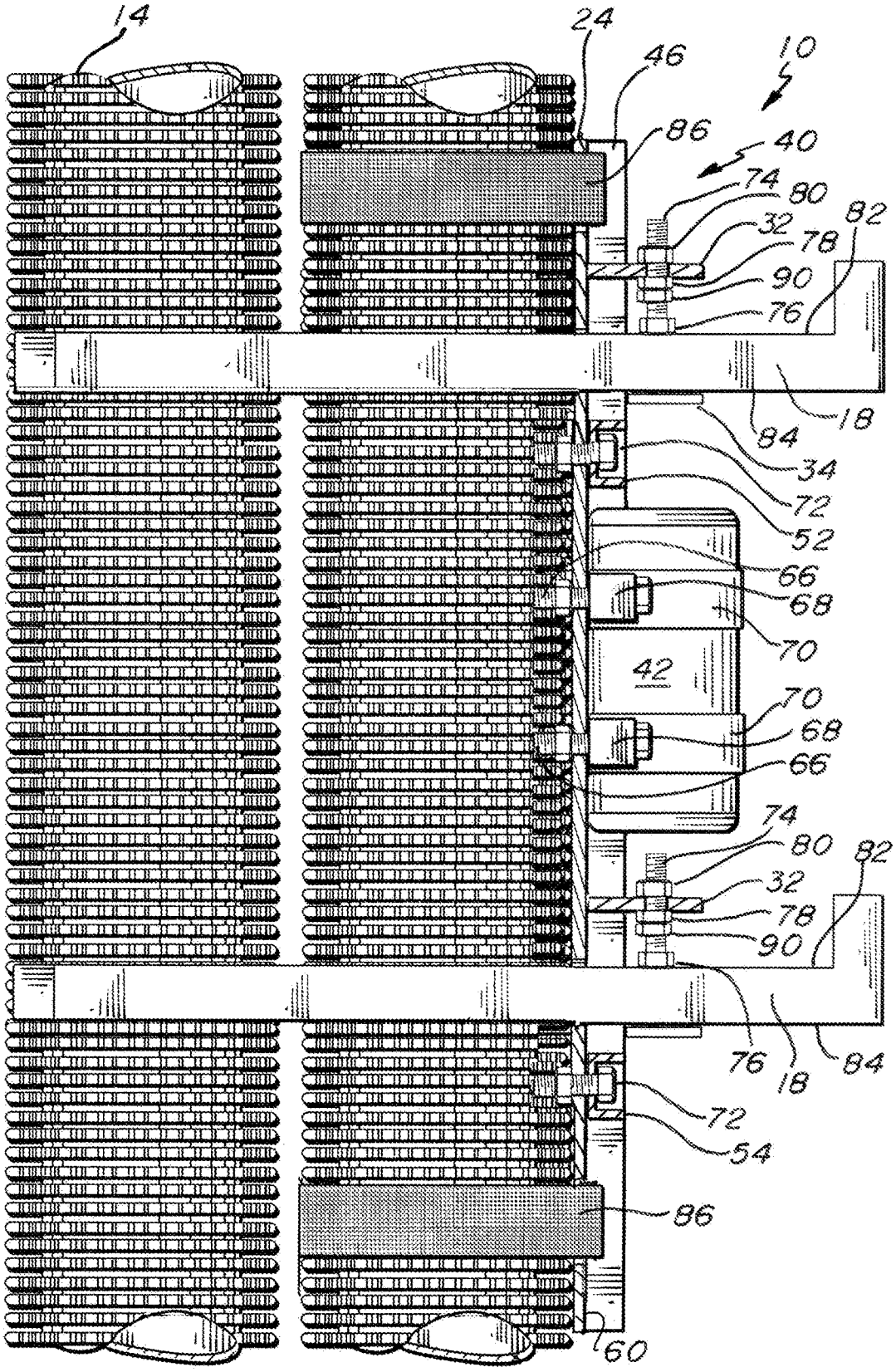
FIG. 3 is a side elevation view of one embodiment of the tube cleaning apparatus.

Referring to FIG. 3, the spreader bar 18 is shown in an inserted position extending between adjacent tubes 14 of at least one, two, three or more adjacent rows of tubes 14 of a tube bank 16. The spreader bar 18 is shown passing through an upper window 28 and a lower window 30.

The releasable connector 40 is shown engaging the upper slotted bracket 32 exerting force downwardly on the top surface 82 of the spreader bar 18, forcing the bottom surface 84 of the spreader bar 18 against the lower bracket 34. In this engaged position the spreader bar 18 is releasably secured to the upper slotted bracket 32 and lower bracket 34.

In the embodiment depicted in FIG. 3, releasable connector 40 includes a threaded bolt 74 including a head 76 a first nut 78, a second nut 80 and a third nut 90. In this embodiment, the first nut 78 may be rotated upwardly to move the head 76 down against the top surface 82. The first nut 78 presses upwardly against the lower surface of the upper slotted bracket 32. Tightening of the first nut 78 occurs until further rotation or tightening of the releasable connector 40 is prohibited.

Next, the third nut 90 may be rotated on the threaded bolt 74 upwardly for secure engagement to the lower surface of the first nut 78. The third nut 90 functions to lock the position of the first nut 78 relative to the lower surface of the upper slotted bracket 32.

In other embodiments, a lock washer may be positioned on the threaded bolt 74 between the upper surface of the upper slotted bracket 32 and the lower surface of the second nut 80. In addition, a lock washer may be positioned on the threaded bolt 74 between the lower surface of the upper slotted bracket 32 and the upper surface of the first nut 78. Further, a lock washer may be positioned on the threaded bolt 74 between the lower surface of the first nut 78 and the upper surface of the third nut 90.

As may be seen in FIG. 3, the upper attachment bar 52 is disposed below the lower bracket 34 proximate to the upper window 28. The bolts and nuts 72 or other mechanical fasteners pass through the upper attachment bar 52 and the back wall 48 and are tightened, to secure the upper attachment bar 52 to the back wall 48. The bolts and nuts 72 or other mechanical fasteners preferably pass through an aperture in the upper attachment bar 52 which is aligned with an aperture through the back wall 48.

As may be seen in FIG. 3, vibrating motor 42 may be releasably secured to a frame 24 through the use of threaded fasteners 66 and mating mechanical fasteners 68. The threaded fasteners 66 and mating mechanical fasteners 68 are preferably aligned in pairs on opposite sides of the vibrating motor 42. The threaded fasteners 66 and mating mechanical fasteners 68 pass through aligned apertures through back wall 48 and are preferably disposed adjacent to the left wall 44 and right wall 46 respectively.

In some embodiments, one or more bands 70 are disposed on the threaded fasteners 66 where tightening of mechanical fasteners 68 on the threaded fasteners 66 compresses the bands 70 relative to the exterior surface of the vibrating motor 42. The bands 70 secure the vibrating motor 42 to the back wall 48.

As may be seen in FIG. 3, below the vibrating motor 42 are located a lower window 30, a second upper slotted bracket 32, a second lower bracket 34, a releasable connector 40, a spreader bar 18, a lower attachment bar 54 and a lower rigging 36. The components, elements, features, attributes and/or functions of the lower window 30, second upper slotted bracket 32, second lower bracket 34, releasable connector 40, spreader bar 18, lower attachment bar 54 and/or lower rigging 36 are identical to the components, elements, features and attributes as earlier described relative to the upper window 28, upper slotted bracket 32, lower bracket 34, releasable connector 40, spreader bar 18, upper attachment bar 52 and upper rigging 36.

Figure 4:
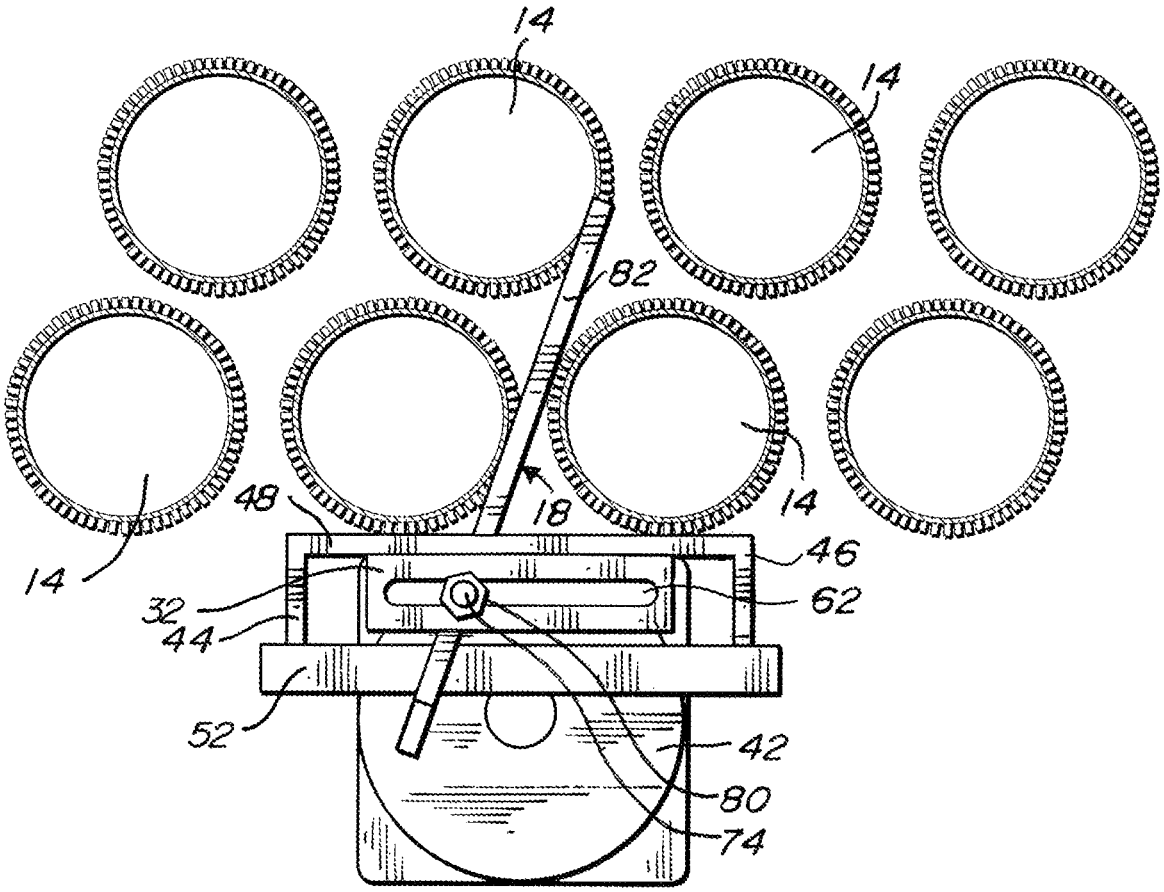
FIG. 4 is a top elevation view of one embodiment of the tube cleaning apparatus.

In at least one embodiment as depicted in FIG. 4, a spreader bar 18 is inserted between adjacent tubes 14 of adjacent rows of a tube bank 16. The frame 24 is shown adjacent to and in contact with one or more tubes 14. In addition, the tube cleaning apparatus 10 is shown in a secured position immediately prior to activation of the vibrating motor 42.

In at least one embodiment the method of use of the boiler cleaning apparatus 10 begins by the placement of one or more frames 24 adjacent to an exterior row of tubes 14 of a tube bank 16. The rigging 36 may be used to secure the frame 24 proximate to the top 58 and bottom 62 one or more tubes 14. The rigging 36 will be threaded through at least one vertical slot 50 and around the tubes 14 and forwardly back through another vertical slot 52 for engagement to the buckle 88, whereupon tightening may occur.

In at least one embodiment, a plurality of frames 24 are positioned adjacent to each other where a right wall 46 of an initial frame 24 is disposed adjacent to the left wall 44 of another frame 24. Any desired number of frames 24 may be disposed adjacent to each other to form a frame assembly.

Once a desired number of frames 24 are disposed adjacent to each other, then an upper attachment bar 52 and a lower attachment bar 54 may be secured to each of the frames 24 of the frame assembly through the use of bolts and nuts 72 or other mechanical fasteners. The frame assembly may then be elevated and positioned to the exterior of a tube bank 16 at any desired height on the tubes 14. The rigging 36 may be used to secure the frame assembly to any desired number of tubes 14 of the tube bank 16. In at least one embodiment, it is anticipated that an upper and lower rigging 36 will be used to releasably affix each individual frame 24 of a frame assembly to the exterior row of tubes 14 of the tube bank 16. In other embodiments, the use of rigging 36 may alternate between the tops 58 and bottom 60 in an alternating pattern, to releasably secure the frame assembly to the tube bank 16. It should be noted that any combination or configuration of rigging 36 proximate to the top 58 and bottom 60 may be used to secure the frame assembly to the exterior of the tube bank 16.

It should also be noted that the threaded fasteners 66 and/or mating mechanical fasteners 68 have been secured to the back wall 48 prior to the attachment of the frames 24 or frame assembly, to the tubes 14 of the tube bank 16.

One or more spreader bars 18 may then be inserted within one or more upper windows 28 and/or lower windows 30, for insertion between adjacent tubes 14 of one or more rows of a tube bank 16. Spreader bars 18 may be inserted between adjacent tubes 14 through the use of a hammer, or alternatively by any known method including the methods described in United States Patent Publication Number US2016-0116158-A1, the disclosure of which is incorporated herein by reference in its entirety. The spreader bars 18 may also be retracted from an inserted position between adjacent tubes 14 by any known method including the methods as described in United States Patent Publication Number US2016-0116158-A1.

In some embodiments, any number or combination of spreader bars 18 may be inserted into a tube bank 16 through any desired upper window 28 are lower window 30. In one embodiment, a single spreader bar 18 is inserted through a single upper window 28 or lower window 30. In an alternative embodiment, more than one spreader bar 18 may be inserted through a single upper window 28 and/or lower window 30, dependent upon the specifications, dimensions, and/or configuration of the tube bank 16, the size of the spreader bar 18, and/or the size of the upper window 28 lower window 30.

In some embodiments a plurality of spreader bars 18 are inserted through any desired number of upper windows 28 or lower windows 30 to provide a desired configuration or pattern. It should be noted that the number of spreader bars 18 utilized in a desired combination, configuration and/or pattern will impart a desired location, amount and/or intensity of vibration to the tubes 14 of a tube bank 16 during cleaning activities.

Following the insertion of the spreader bars 18 within the tube bank 16, a releasable connector 40 may be engaged to an upper slotted bracket 32 of an upper window 28 or a lower window 30 for each spreader bar 18. When the spreader bars 18 have been inserted into a tube bank 16, the bottom surface is 84 will be in contact with and rest upon the upper surface of a lower bracket 34, which is adjacent to either the lower edge of an upper window 28 or the lower edge of the lower window 30.

In at least one embodiment, a first nut 78 as rotatably engaged to a threaded bolt 74 is disposed proximate to the head 76. In another embodiment, the third nut 90 may be disposed on threaded bolt 74 proximate to the head 76, prior to the engagement of the first nut 78 to the threaded bolt 74. The upper portion of the threaded bolt 74 may then be elevated upwardly through the slot 62 of the upper slotted bracket 32.

A second nut 80 may then be attached to the threaded bolt 72 above the slot 62 of the upper slotted bracket 32. Sufficient distance should exist between the upper surface of the first nut 78 and the lower surface of the second nut 80 to permit the threaded bolt 72 to be elevated within the slot 62. Following the positioning of the head 76 onto the top surface 82, the first nut 78 may be rotated away from the head 76 towards the lower surface of the upper slotted bracket 32.

Rotation of the first nut 78 upwardly may continue until the first nut 78 contacts the lower surface of the upper slotted bracket 32. Rotation will continue to tighten the threaded bolt 74 between the top surface 82 of the spreader bar 18 and the lower surface of the upper slotted bracket 32, preferably locking the spreader bar 18 a desired engaged position relative to the frame 24. Following the tightening of the first nut 78, the spreader bar 18 will not move or separate relative to either the upper window 28 and/or lower window 30 when exposed to vibration from the vibrating motor 42.

Once tightening of the first nut 78 relative to the lower surface of the upper slotted bracket 32 has occurred, then the second nut 80 above the slot 62 and the upper slotted bracket 32 may be rotated in a downward direction onto the upper surface of the upper slotted bracket 32. Tightening of the second nut 80 downwardly may continue until further rotation is difficult. In this configuration the upper slotted bracket 32 will preferably be securely pinched between the first nut 78 and the second nut 80.

In the engaged position the upper surface of the lower bracket 34 and the lower surface of the upper slotted bracket 32 are the bearing surfaces to fixedly secure the spreader bar 18 to the frame 24, within a desired location relative to an upper window 28 and/or lower window 30.

In at least one embodiment, prior to, or following of the secure attachment of the spreader bar 18 to the frame 24, the vibrating motor 42 may be releasably secured to the central section 64 of the back wall 48. In this embodiment, the mating mechanical fastener 68 may be separated from the threaded fasteners 66 permitting any band 70, or other affixation mechanism to be removed or released to accommodate the positioning of the vibrating motor 42 proximate to the central section 64. Once the vibrating motor 42 has been placed into a desired location relative to the frame 24 then the band 70 or other affixation mechanism may be disposed to the exterior of the vibrating motor 42 and the mechanical fastener 68 may be re-attached and/or tightened relative to the threaded fastener 66 in order to releasably couple vibrating motor 42 to the frame 24.

Operation of the vibrating motor 42 will transfer vibration to the frame 24, to the spreader bars 18, and ultimately to the tubes 14 in order to facilitate cleaning.

During disassembly, the vibrating motor 42 may be released and separated from central section 64 of the back wall 48. The mechanical fastener 68 and/or bands 70 or other affixation mechanism may or may not be reattached to the frame 24 following removal of the vibrating motor 42.

The releasable connector 40 may then be loosened to permit the spreader bar 18 to be withdrawn from any upper window 28 or lower window 30. It should be noted that the releasable connector 40 is not required to be completely disassembled and separated from the upper slotted bracket 32 and may be sufficiently loosened to enable the retraction of the spreader bars 18 from the tube bank 16.

The release of the buckle 88, on cinching web or strap 86 may then occur, where the web or strap 86 are separated from the tubes 14 and vertical slots 50 in order to release the frame's 24 or frame assembly from the exterior of a tube bank 16.

Once the spreader bars 18 have been removed from the tube bank 16, and once the rigging 36 has been removed from the tube bank 16, then the frame's 24 and/or frame assembly may be separated and relocated to another location on a tube bank 16 to continue cleaning activities. The releasable attachment procedure may then be repeated for alternative cleaning locations.

In at least one embodiment, the rigging 36 includes a heavy duty cinching web or strap 86, one end of which is engaged with buckle 88. The buckle 88 may include a handle and a ratchet and pawl mechanism to facilitate tightening. The cinching web or strap 86 may have a dimension equal to, larger or smaller than 2 inches in width, and have a breaking strength of approximately 1660 pounds. In other embodiments, the breaking strength of the cinching web or strap 86 may exceed or be less than 1660 pounds dependent upon specifications selected for the frame 24, the vibrating motor 42 and the dimensions and specification of the tubes 14. The cinching web or strap 86 may alternatively be known as a lashing strap and may be formed of nylon or other desired materials.

In at least one embodiment, a spreader bar is formed of solid metal material such as iron and/or steel. The spreader bar 18 may alternatively be formed of other metal materials or composite materials, or combinations of materials provided that the spreader bar 18 does not fracture or fail to perform the purposes as identified herein.

In one embodiment, the spreader bar 18 may include an L-shaped working end, and a pointed or tapered end opposite to the working end. In between the pointed or tapered end and the working end, the opposite sides of the spreader bar 18 are preferably parallel and flat.

In some embodiments, the central section of the spreader bar may have any height or width dimension equal to, or larger or smaller than 1 and 11/16 inches. The width dimension of the spreader bar 18 may be equal to, greater or less than 1 inch. The working end having the L-shape may extend normally relative to the spreader bar 18 a dimension equal to, larger or smaller than 5 inches. The width of the L-section, working end of the spreader bar 18 may be equal to, more or less than 2 inches. Spreader bar 18 may have any length dimension equal to, larger or smaller than 2'8". The point of the spreader bar 18 may be tapered along the opposite sides extending for a dimension equal to, greater or less than 4 inches. In other embodiments the spreader bar 18 may have any dimension larger or smaller than the dimensions identified herein, dependent upon the number of rows included in the tube bank 16, the diameter of the spacing between tubes 14, the size of the frame's 24, the size of the upper window 28 and lower window 30, as well as the size of the vibrating motor 42. In at least one embodiment, the spreader bar 18 does not include an L-shape working end.

In at least one embodiment, the upper attachment bar 52 and lower attachment bar 54 are formed of metallic material such as iron or steel. The upper attachment bar 52 and lower attachment bar 54 may alternatively be formed of other metal materials, or composite materials or combination materials, provided that the upper attachment bar 52 and lower attachment bar 54 to not fracture or fail to perform the purposes as identified herein.

In some embodiments, the upper attachment bar 52 and lower attachment bar 54 have a length dimension equal to, larger or smaller than 4 feet. The width of the upper attachment bar 52 and lower attachment bar 54 may be equal to, larger or smaller than 3 inches. In at least one embodiment, each of the upper attachment bar 52 and lower attachment bar 54 includes a pair of opposite vertical walls having a height dimension equal to, larger or smaller than 1 inch.

In at least one embodiment, the upper attachment bar 52 and lower attachment bar 54 include a plurality of openings which may be spaced centrally between the pair of vertical opposite walls. The openings in at least one embodiment may be spaced at a dimension of 1 and ⅞ inches; 10 and ⅞ inches; 1 foot and 1 and ⅝ inches; 1 foot and 10 and ⅝ inches; 2 feet 1 and ⅜ inches; 2 feet and 10 and ⅜ inches; 3 feet and 1 and ⅛ inch; and 3 feet 10 and ⅛ inches from one end of the upper attachment bar 52 and lower attachment bar 54. It should be noted that the spacing of the openings through the upper attachment bar 52 and lower attachment bar 54 may be adjusted to accommodate various sized frames 24 and/or vibrating motors 42 as well as the spacing between tubes 14.

In at least one embodiment, each frame 24 is formed of metallic material such as iron or steel. Each frame 24 may alternatively be formed of other metal materials, composite materials, or combinations of materials provided that each frame 24 does not fracture or fail to perform purposes identified herein. The dimensions identified for the frame 24 herein may be larger or smaller than indicated, dependent on the size of the tubes 14 and tube bank 16 as well as the vibrating motor 42 and/or spreader bar 18.

In some embodiments each frame 24 has a height dimension equal to, greater or smaller than 3'10". Each frame 24 is preferably uniform in size and dimension, and has a width dimension of 1'3" prior to the creation of the left wall 44 and right wall 46. Each of the left wall 44 and right wall 46 have a height dimension equal to, larger or smaller than 2 inches. Each of the left wall 44 and right wall 46 are preferably integral to the frame 24 and are formed by bending. The back wall 48 of the frame 24 therefore has a width dimension equal to, larger or smaller than 11 inches. The frame 24 may have a thickness dimension equal to, greater or less than ¾ inch provided that the frame 24 does not fracture or fail to perform the purposes as identified herein when exposed to vibration from the vibrating motor 42.

Each frame 24 preferably includes a plurality of vertical slots 50 proximate to the top 58 and bottom 60. Each of the vertical slots 50 is preferably regularly and evenly spaced on the back wall 48 between the interior of each of the left wall 44 and right wall 46. Each vertical slot 50 preferably has a height dimension equal to, larger or smaller than 2 and ¼ inches. Each vertical slot 50 may have a width dimension equal to, larger or smaller than ¼ inch. Each vertical slot 50 is preferably spaced from an adjacent vertical slot 50, center of slot 50 to center of adjacent slot 50, of a dimension equal to, larger or smaller than ¾ inch. The dimensions identified herein for the frame 24 and vertical slots 50 may be increased or decreased dependent upon the size or height of the tubes 14 and/or tube bank 16 to be cleaned, as well as the size of the spreader bar 18 and/or vibrating motor 42 selected for cleaning activities.

In at least one embodiment, an upper slotted bracket 32 is disposed below the vertical slots 50 proximate to the top 38. The upper slotted bracket 32 is preferably formed of metallic material such as iron or steel. Alternatively, the upper slotted bracket 32 may be formed of iron or steel, other metal materials, other materials, composite materials or combinations of materials provided that each upper slotted bracket 32 does not fracture or fail to perform purposes identified herein.

In at least one embodiment, the upper slotted bracket 32 is located 2¾ inches below the vertical slots 50 at the top 58. The distance that the upper slotted bracket 32 is below the vertical slots 50 at the top 58 may be increased or decreased dependent upon the size or height of the tubes 14 and/or tube bank 16 to be cleaned, as well as the size of the spreader bars 18.

In at least one embodiment the upper slotted bracket 32 has a length dimension equal to, larger or smaller than 6 inches. The upper slotted bracket 32 may also have a thickness dimension equal to, larger or smaller than 3/16 inch. The upper slotted bracket 32 preferably has a width dimension extending outwardly from the back wall 48 by a distance equal to, greater or less than 3 inches. The slot 62 of the upper slotted bracket 32 is preferably centered relative to the edges of the upper slotted bracket 32 having a width dimension equal to, greater or smaller than ½ inch. The slot 62 also has a length dimension equal to, greater or smaller than 5 inches, and is preferably centered, and is 1 inch inwardly relative to the opposite sides of the upper slotted bracket 32. In at least one embodiment, the upper slotted bracket 32 is welded to the back wall 48 extending perpendicularly outwardly therefrom in a direction away from the tubes 14 of the tube bank 16.

In at least one embodiment, the upper edge of the rectangular upper window 28 is approximately 1½ inches below the upper slotted bracket 32. The upper window 28 passes through the back wall 48 to provide access to the tube bank 16. The rectangular upper window 28 is preferably centered relative to the back wall 48 and is 6 inches wide and 3 inches high. The upper window 28 may be located closer to, or further away from, the top 58 at the discretion of an individual depending upon the size of the frame 24, the height and diameter of the tubes 14, the height or size of the tube bank 16, and the dimension selected for the spreader bar 18 and releasable connector 40. The size of the upper window 28 may be larger or smaller than 6 inches wide and 3 inches high at the discretion of an individual depending upon the size of the frame 24, the height dimension of the tubes 14, the size of the tube bank 16, and the dimension selected for the spreader bar 18 and releasable connector 40.

In at least one embodiment, a lower bracket 34 is located directly below and proximate to the lower edge of the upper window 28. The lower bracket 34 is preferably formed of metallic material such as iron or steel. Alternatively, the lower bracket 34 may be formed of other metal materials, composite materials or combinations of materials provided that the lower bracket 34 does not fracture or fail to perform purposes as identified herein.

In at least one embodiment, the lower bracket 34 has a length dimension equal to, larger or smaller than 6 inches. The lower bracket 34 may also have a thickness dimension equal to, larger or smaller than 3/16 inch. The lower bracket 34 preferably has a width dimension, extending outwardly from the back wall 48 by a distance equal to, larger or smaller than 3 inches.

The lower bracket 34 preferably functions as a ledge for the spreader bar 18 during and following the insertion of the spreader bar 18 into the tube bank 16. In addition, the lower bracket 34 functions as the lower bearing surface for the bottom surface 84 during the tightening and releasable affixation of the releasable connector 40 between the upper slotted bracket 32, spreader bar 18 and lower bracket 34. The dimensions selected for the lower bracket 34 may be increased or decreased at the preference of an individual depending on the size of the frame 24 height and diameter of the tubes 14, the height or size of the tube bank 16 and the dimension selected for the upper window 28 and spreader bar 18. In at least one embodiment, the lower bracket 34 is welded to the back wall 48 extending perpendicularly outwardly therefrom in a direction away from the tubes 14 of the tube bank 16.

In at least one embodiment a second lower bracket 34 is disposed above the vertical slots 50 proximate to the bottom 60. The second lower bracket 34 preferably has the dimensions and is formed of materials which are identified for the lower bracket 34 proximate to the upper window 28 as described herein.

The second lower bracket 34 is located directly below and proximate to the lower edge of the lower window 30. In at least one embodiment, the second lower bracket 34 is positioned a distance equal to, greater or less than 4 inches above the vertical slots 50. The distance that the second lower bracket 34 is above the bottom vertical slots 50 may be increased or decreased dependent upon the size and height of the tubes 14 and/or tube bank 16, as well as the size of the spreader bar 18, or window 30, and frame 24.

At least one embodiment, the lower edge of the lower window 30 is adjacent to and directly above the second lower bracket 34. The lower window 30 passes through the back wall 48 to provide access to the tube bank 16. The lower window 30 is preferably the same size and shape as the upper window 28. The location of the lower window 30 may likewise be re-positioned by an individual dependent upon considerations as identified herein. The size of the lower window 30 may also be increased or decreased dependent upon the considerations as identified herein.

In at least one embodiment, a second upper slotted bracket 32 is disposed approximately 1½ inches above the lower window 30. The second upper slotted bracket 32 preferably has the identical dimensions and features as earlier described relative to the upper slotted bracket 32 disposed above the upper window 28. The second upper slotted bracket 32 may also be increased or decreased in size dependent upon considerations as previously identified herein.

The area of the back wall 48 between the lower bracket 34 and the top of the second upper slotted bracket 32 proximate to lower window 30, is the central section 64 of the frame 24. The central section 64 in at least one embodiment has a height dimension equal to, larger or smaller than approximately 2'4". The central section 64 preferably includes a plurality of matching and spaced holes which receive metallic threaded fasteners 66 and/or metallic mating mechanical fasteners 68. In some alternative embodiments, the threaded fasteners 66 and/or mating mechanical fasteners 68 may be formed of steel or other metal materials, or other materials provided that the functions, features and attributes as identified herein are not sacrificed or adversely affected by the materials selected.

In a first alternative embodiment the tube cleaning device cleans a plurality of tubes of a tube bank, the tube cleaning device has a frame, the frame has a top, a bottom, a plurality of top vertical slots proximate to the top, a plurality of bottom vertical slots proximate to the bottom, a first upper slotted bracket disposed below the plurality of top vertical slots, an upper window disposed below the first upper slotted bracket, a first lower bracket disposed proximate to and below the upper window, a second lower bracket proximate to and above the bottom vertical slots, a lower window disposed proximate to and above the second lower bracket, a second upper slotted bracket disposed above the lower window, and a central section between the first lower bracket and the second upper slotted bracket; a first rigging engaged to at least one of the top vertical slots and at least one of the plurality of tubes, a second rigging engaged to at least one of the bottom vertical slots and at least one of plurality of the tubes; at least one spreader bar, the at least one spreader bar being disposed through at least one of the upper window and the lower window, the at least one spreader bar being constructed and arranged for engagement to a plurality of the tubes of the tube bank; at least one releasable connector, the at least one releasable connector releasably securing the at least one spreader bar to the first upper slotted bracket and the first lower bracket or the second upper slotted bracket and the second lower bracket; and a vibrating motor, the motor being engaged to the central section, wherein the motor causes vibration and the vibration is transferred from the motor to the frame, and the vibration is transferred from the frame to the at least one spreader bar, and the vibration is transferred from the at least one spreader bar to the plurality of tubes of the tube bank.

In a second alternative embodiment according to the first embodiment, the frame is vertically elongate having a left wall, a right wall and a back wall, the upper window and the lower window traversing the back wall, and the first upper slotted bracket, the first lower bracket, the second upper slotted bracket and the second lower bracket extend normally outwardly from the back wall.

In a third alternative embodiment according to the second embodiment, the first upper slotted bracket and the second upper slotted bracket include a slot.

In a fourth alternative embodiment according to the third embodiment, at least a portion of the at least one releasable connector passes through the slot.

In a fifth alternative embodiment according to the second embodiment, the cleaning device has at least two spreader bars, one of the spreader bars being disposed through the upper window and one of the spreader bars being disposed through the lower window.

In a sixth alternative embodiment according to the second embodiment, the first rigging has an elongate web and a buckle, the buckle has a ratchet mechanism, the web passing rearwardly through one of the top vertical slots and behind at least one of the plurality of tubes, the web further passing forwardly through another of the top vertical slots for engagement to the buckle.

In a seventh alternative embodiment according to the sixth embodiment, the second rigging has another elongate web and another buckle, the another buckle has another ratchet mechanism, the another web passes rearwardly through one of the bottom vertical slots and behind at least one of the plurality of tubes and the another web further passing forwardly through one additional vertical slot of the bottom vertical slots for engagement to the another buckle.

In an eighth alternative embodiment according to the second embodiment, the motor is releasably secured to the frame through the use of at least one band and releasable fasteners engaged to the back wall.

In a ninth alternative embodiment according to the second embodiment, each of the at least one spreader bar has a top spreader bar surface and a bottom spreader surface.

In a tenth alternative embodiment according to the second embodiment, the tube cleaning device has a non-engaged configuration when the at least one spreader bar is not inserted into the tube bank, and an engaged position when the at least one spreader bar is inserted within the tube bank.

In an eleventh alternative embodiment according to the tenth embodiment, in the engaged position the bottom spreader bar surface is in contact with the first lower bracket or the second lower bracket.

In a twelfth alternative embodiment according to the eleventh embodiment, the at least one releasable connector is in contact with and is positioned between the top spreader bar surface and the slot of the first upper slotted bracket or the second upper slotted bracket.

In a thirteenth alternative embodiment according to the twelfth embodiment, the at least one releasable connector is expanded, exerting force downwardly against the first lower bracket or the second lower bracket and upwardly against the first upper slotted bracket or the second upper slotted bracket.

In a fourteenth alternative embodiment according to the thirteenth embodiment, the at least one spreader bar is securely and releasably attached to the frame within the upper window or the lower window.

In a fifteenth alternative embodiment according to the fourteenth embodiment, the at least one releasable connector is releasably secured to the first upper slotted bracket or the second upper slotted bracket above and below the slot.

In a sixteenth alternative embodiment according to the second embodiment, the frame, the at least one spreader bar, and the at least one releasable connector are formed of metal.

In a seventeenth alternative embodiment according to the second embodiment, the cleaning device further comprises a plurality of frames disposed adjacent to each other wherein the right wall of one of said frames is proximate to the left wall of an adjacent frame and the plurality of frames form a frame assembly.

In an eighteenth alternative embodiment according to the seventeenth embodiment, the frame assembly further comprises an upper attachment bar engaged to the plurality of frames below the first lower bracket and above the motor.

In a nineteenth alternative embodiment according to the eighteenth embodiment, the frame assembly further comprises a lower attachment bar engaged to the plurality of frames above the second upper slotted bracket and below the motor.

In a twentieth alternative embodiment according to the seventeenth embodiment, each of the plurality of frames of the frame assembly are releasably secured to the tube bank proximate to the top and proximate to the bottom of the frames.

In a twenty-first alternative embodiment according to the seventeenth embodiment, a plurality of spreader bars may be disposed through at least one of the upper windows and the lower windows in any desired configuration.

In a twenty-second alternative embodiment according to the seventeenth embodiment, a plurality of spreader bars may be disposed through at least one of the upper windows and the lower windows in any desired pattern.

In a twenty-third alternative embodiment according to the seventeenth embodiment, the motor may be releasably secured to any one of the frames forming the frame assembly.

In a twenty-fourth alternative embodiment a method of cleaning a plurality of tubes of a tube bank, includes the steps of positioning a frame proximate to a tube bank, the frame comprising a top, a bottom, a plurality of top vertical slots proximate to the top, a plurality of bottom vertical slots proximate to the bottom, a first upper slotted bracket disposed below the plurality of top vertical slots, an upper window disposed below the first upper slotted bracket, a first lower bracket disposed proximate to and below the upper window, a second lower bracket proximate to and above the bottom vertical slots, a lower window disposed proximate to and above the second lower bracket, a second upper slotted bracket disposed above the lower window, and a central section between the first lower bracket and the second upper slotted bracket; releasably securing the frame to the tube bank through the use of a first rigging engaged to at least one of the top vertical slots and at least one of the plurality of tubes, a second rigging engaged to at least one of the bottom vertical slots and at least one of plurality of tubes; inserting at least one spreader bar through at least one of the upper window and the lower window, the at least one spreader bar engaging the plurality of tubes; attaching and tightening the at least one releasable connector, the at least one releasable connector releasably securing the at least one spreader bar to the first upper slotted bracket and the first lower bracket or the second upper slotted bracket and the second lower bracket, the at least one releasable connector engaging the spreader bar and the first upper slotted bracket or the second upper slotted bracket; releasably securing a vibrating motor to the frame; activating the motor to cause vibration where the vibration is transferred from the motor to the frame, the vibration is transferred from the frame to the at least one spreader bar, and the vibration is transferred from the at least one spreader bar to the plurality of tubes of the tube bank; and continuing the vibration for a desired period of time to clean the tubes of the tube bank.

In a twenty-fifth alternative embodiment according to the twenty-fourth embodiment, the method includes the further step of terminating vibration of the motor and releasing the at least one releasable connector, from engagement to the at least one spreader bar and the first upper slotted bracket or the second upper slotted bracket.

In a twenty-sixth alternative embodiment according to the twenty-fifth embodiment, the method includes the further step of withdrawing the at least one spreader bar from the upper window or the lower window.

In a twenty-seventh alternative embodiment according to the twenty-sixth embodiment, the method includes the further step of releasing and separating the first rigging from the top vertical slots and the at least one of the plurality of tubes, and releasing and separating the second rigging from the bottom vertical slots and the at least one of plurality of tubes.

In a twenty-eighth alternative embodiment according to the twenty-seventh embodiment, the method includes the further step of separating the frame from the tube bank and relocating the frame proximate to another portion of the tube bank.

In a twenty-ninth alternative embodiment according to the twenty-eighth embodiment, the method includes the further step of re-attaching the frame to the tube bank at another location, inserting the spreader bar through the upper window or the lower window, releasably connecting the spreader bar to the frame and re-engaging the motor to clean the another location of the tube bank.

In a thirtieth alternative embodiment according to the twenty-ninth embodiment, the method includes the further step of using a plurality of frames positioned adjacent to each other and securing an upper attachment bar to the plurality of frames and a lower attachment bar to the plurality of frames to form a frame assembly.

This completes the description of the preferred and alternate embodiments of the invention. Those skilled in the art may recognize other equivalents to the specific embodiment described herein which equivalents are intended to be encompassed by the claims attached hereto.

The above disclosure is intended to be illustrative and not exhaustive. This description will suggest many variations and alternatives to one of ordinary skill in this art. The various elements shown in the individual figures and described above may be combined or modified for combination as desired. All these alternatives and variations are intended to be included within the scope of the claims where the term "comprising" means "including, but not limited to".

These and other embodiments which characterize the invention are pointed out with particularity in the claims annexed hereto and forming a part hereof. However, for further understanding of the invention, its advantages and objectives obtained by its use, reference should be made to the drawings which form a further part hereof and the accompanying descriptive matter, in which there is illustrated and described embodiments of the invention.

We claim:

1. A cleaning device, said cleaning device cleaning a plurality of tubes of a tube bank, said cleaning device comprising:

a frame, said frame having a top, a bottom, a plurality of top vertical slots proximate to said top, a plurality of bottom vertical slots proximate to said bottom, a first upper slotted bracket disposed below said plurality of top vertical slots, an upper window disposed below said first upper slotted bracket, a first lower bracket disposed proximate to and below said upper window, a second lower bracket proximate to and above said plurality of bottom vertical slots, a lower window disposed proximate to and above said second lower bracket, a second upper slotted bracket disposed above said lower window, and a central section between said first lower bracket and said second upper slotted bracket;

a first rigging engaged to at least one of said top vertical slots and at least one of said plurality of tubes, a second rigging engaged to at least one of said bottom vertical slots and at least one of said plurality of tubes;

at least one spreader bar, said at least one spreader bar being disposed through at least one of said upper window and said lower window, said at least one spreader bar being constructed and arranged for engagement to said plurality of tubes;

at least one releasable connector, said at least one releasable connector releasably securing said at least one spreader bar to said first upper slotted bracket and said first lower bracket, or to said second upper slotted bracket and said second lower bracket; and a vibrating motor, said motor being engaged to said central section, wherein said motor causes vibration and said vibration is transferred from said motor to said frame, and said vibration is transferred from said frame to said at least one spreader bar, and said vibration is transferred from said at least one spreader bar to said plurality of tubes of said tube bank.

2. The cleaning device according to claim 1, wherein each of said first upper slotted bracket and said second upper slotted bracket includes a slot and at least a portion of said at least one releasable connector passes through said slot.

3. The cleaning device according to claim 2, said cleaning device having at least two spreader bars, one of said at least two spreader bars being disposed through said upper window and another of said at least two spreader bars being disposed through said lower window.

4. The cleaning device according to claim 2, said first rigging having an elongate web and a buckle, said buckle having a ratchet mechanism, said web passing rearwardly through one of said plurality of top vertical slots and behind at least one of said plurality of tubes, said web further passing forwardly through another of said plurality of top vertical slots for engagement to said buckle.

5. The cleaning device according to claim 2, wherein said motor is releasably secured to said frame through the use of at least one band and releasable fasteners engaged to said frame.

6. The cleaning device according to claim 2, wherein said cleaning device has a non-engaged configuration when said at least one spreader bar is not inserted into said tube bank, and an engaged position when said at least one spreader bar is inserted within said tube bank.

7. The cleaning device according to claim 6, wherein in said engaged position said at least one spreader bar is in contact with said first lower bracket or said second lower bracket.

8. The cleaning device according to claim 7, wherein said at least one releasable connector is in contact with and is positioned between said at least one spreader bar and said slot of said first upper slotted bracket or said slot of said second upper slotted bracket.

9. The cleaning device according to claim 8, wherein said at least one releasable connector is expanded, exerting force downwardly against said at least one spreader bar and said first lower bracket or said second lower bracket and upwardly against said first upper slotted bracket or said second upper slotted bracket.

10. The cleaning device according to claim 1, said cleaning device further comprising a plurality of frames disposed adjacent to each other, each of said plurality of frames having a left wall and a right wall, wherein said right wall of one of said plurality of frames is proximate to said left wall of an adjacent frame and said plurality of frames form a frame assembly.

11. The cleaning device according to claim 10, said frame assembly further comprising an upper attachment bar engaged to said plurality of frames.

12. A method of cleaning a plurality of tubes of a tube bank, said method comprising:

providing a cleaning device, said cleaning device comprises:

a frame, said frame having a top, a bottom, a plurality of top vertical slots proximate to said top, a plurality of bottom vertical slots proximate to said bottom, a first upper slotted bracket disposed below said plurality of top vertical slots, an upper window disposed below said first upper slotted bracket, a first lower bracket disposed proximate to and below said upper window, a second lower bracket proximate to and above said plurality of bottom vertical slots, a lower window disposed proximate to and above said second lower bracket, a second upper slotted bracket disposed above said lower window, and a central section between said first lower bracket and said second upper slotted bracket a first rigging engaged to at least one of said plurality of top vertical slots and at least one of said plurality of tubes, a second rigging engaged to at least one of said plurality of bottom vertical slots and at least one of said plurality of tubes;

at least one spreader bar, said at least one spreader bar being disposed through at least one of said upper window and said lower window, said at least one spreader bar being constructed and arranged for engagement to said plurality of tubes;

at least one releasable connector, said at least one releasable connector releasably securing said at least one spreader bar to said first upper slotted bracket and said first lower bracket, or to said second upper slotted bracket and said second lower bracket; and a vibrating motor, said motor being engaged to said central section, wherein said motor causes vibration and said vibration is transferred from said motor to said frame, and said vibration is transferred from said frame to said at least one spreader bar, and said vibration is transferred from said at least one spreader bar to said plurality of tubes of said tube bank;

said method further comprising:

positioning said frame proximate to said tube bank;

releasably securing said frame to said tube bank through the use of said first rigging engaged to at least one of said plurality of top vertical slots and at least one of said plurality of tubes, and the use of said second rigging engaged to at least one of said plurality of bottom vertical slots and at least one of said plurality of tubes;

inserting said at least one spreader bar through at least one of said upper window and said lower window, said at least one spreader bar engaging said plurality of tubes;

attaching and tightening said at least one releasable connector, said at least one releasable connector releasably securing said at least one spreader bar to said first upper slotted bracket and said first lower bracket or to said second upper slotted bracket and said second lower bracket, said at least one releasable connector engaging said at least one spreader bar and said first upper slotted bracket or said second upper slotted bracket;

releasably securing said motor to said frame;

activating said motor to cause vibration where said vibration is transferred from said motor to said frame, said vibration is transferred from said frame to said at least one spreader bar, and said vibration is transferred from said at least one spreader bar to said plurality of tubes of said tube bank; and continuing said vibration for a desired period of time to clean said plurality of tubes of said tube bank.

13. The method of claim 12, further comprising terminating vibration of said motor and releasing said at least one releasable connector, from engagement to said at least one spreader bar and said first upper slotted bracket or said second upper slotted bracket.

14. The method of claim 13, further comprising withdrawing said at least one spreader bar from said upper window or said lower window.

15. The method of claim 14, further comprising releasing and separating said first rigging from said plurality of top vertical slots and said at least one of said plurality of tubes, and releasing and separating said second rigging from said plurality of bottom vertical slots and said at least one of plurality of tubes.

16. The method of claim 15, further comprising separating said frame from said tube bank and relocating said frame to another location of said tube bank.

17. The method of claim 16, further comprising reattaching said frame to said tube bank at said another location, inserting said at least one spreader bar through said upper window or said lower window, releasably connecting said at least one spreader bar to said frame and reengaging said motor to clean said another location of said tube bank.

18. The method of claim 17, further comprising using a plurality of frames positioned adjacent to each other and securing an upper attachment bar to said plurality of frames and a lower attachment bar to said plurality of frames to form a frame assembly.

* * * * *